United States Patent [19]

Gray

[11] Patent Number: 5,028,171

[45] Date of Patent: Jul. 2, 1991

[54] REUSABLE OFFSHORE PLATFORM WITH SKIRT PILES

[75] Inventor: Daniel W. Gray, Houston, Tex.

[73] Assignee: McDermott International, Inc., New Orleans, La.

[21] Appl. No.: 528,524

[22] Filed: May 25, 1990

[51] Int. Cl.[5] ..... E02B 17/02

[52] U.S. Cl. ..... 405/225; 405/227

[58] Field of Search ..... 405/195, 224, 225, 227, 405/228, 232, 233

[56] References Cited

U.S. PATENT DOCUMENTS

| | | | |
|---|---|---|---|
| 3,347,053 | 10/1967 | Manning | 405/225 |
| 4,378,179 | 3/1983 | Hasle | 405/227 |
| 4,585,374 | 4/1986 | Regalbuto et al. | 405/227 |
| 4,721,417 | 1/1988 | Piazza et al. | 405/227 |

*Primary Examiner*—David H. Corbin

*Attorney, Agent, or Firm*—Robert J. Edwards; Michael L. Hoelter

[57] ABSTRACT

This invention pertains to a re-usable offshore platform that is secured in place by skirt piles. The platform is constructed with skirt pile sleeves having an interior insert that is subsequently connected to the skirt pile. Prior to salvage, or re-use, the connection between the sleeve and the insert is cut thereby enabling the skirt pile to be removed which consequently allows the platform to be moved. Upon re-use or re-positioning, a new insert is installed and secured within the sleeve after-which new skirt piles are stabbed through the insert and embedded in the seafloor. Alternatively, should larger piles be needed at the new location, the larger piles can be stabbed through the sleeve itself thereby eliminating the need for new inserts.

16 Claims, 3 Drawing Sheets

REUSABLE OFFSHORE PLATFORM WITH SKIRT PILES

FIELD OF THE INVENTION

This invention pertains to offshore platforms that are secured in place with skirt piles, and more particularly to a platform that may be easily removed or salvaged and, if desired, re-used or re-located.

BACKGROUND OF THE INVENTION

In the past, it was often more economical to design and build a new offshore platform than to attempt to salvage and re-use one already in place. This is because most of the existing platforms with skirt piles were secured in place by bonding the skirt pile to the jacket leg using grout, and no economical means of breaking this grout bond has been found. Consequently, if a platform were to be re-used, the jacket, in its entirety, would have to be salvaged, towed to a fabrication yard, and supported in dry dock so as to replace the jacket legs. Alternatively, if jacket leg replacement was to be avoided, the platform could be re-secured in place at the new location by using smaller diameter piles (i.e., sized to fit within the original piles previously grouted to the jacket leg) with deeper penetration. This option, however, is only feasible where these smaller diameter piles are able to supply the strength required to adequately secure the platform in the new location. Oftentimes, this is not possible because the original piles, in an effort to save money and weight, were already of minimum size and thus the use of even smaller piles would not be feasible.

It is thus an object of this invention to provide a design for attaching skirt piles to a jacket leg such that the platform may be re-used if needed without resorting to the replacement of the jacket leg or the use of smaller diameter piles. Another object of this invention is to provide a skirt pile-to-jacket leg connection that can be broken such that the platform may be conveniently salvaged. Another object of this invention is to provide a skirt pile-to-jacket leg connection that is pre-fabricated along with the platform itself such that when re-use of the platform is desired, the connecting assembly for securing each jacket leg to the new set of skirt piles is already in place. These and other advantages of this invention will become obvious upon further investigation.

SUMMARY OF THE INVENTION

This invention pertains to an offshore platform whose jacket legs support a plurality of skirt pile sleeves. Prior to launching, an insert cylinder is secured within each said sleeve by a series of shims welded between the two. Subsequently, and upon the proper positioning of the platform, a skirt pile is stabbed through the insert and embedded below the mudline. Afterwards, the pile is secured to the insert so as to anchor the platform in place.

When the platform is to be salvaged, the skirt pile is cut at or below the mudline while the shims securing the insert to the sleeve are also cut. This enables the skirt pile and the insert, which are connected together, to be removed, afterwhich the platform may be moved and/or re-used.

Should the platform be re-used, it is first towed to the proper location and positioned on the seafloor. Then, provided the same or smaller sized skirt piles are required at the new location, a new insert is installed within each of the sleeves which is subsequently grouted to the sleeve. Afterwards, the same or smaller sized skirt pile is stabbed through the insert and grouted in place. Alternatively, should a larger skirt pile than originally used be necessary at the new location, this larger pile is stabbed through the sleeve itself, thereby eliminating the insert, and directly grouted to the sleeve.

DETAILED DESCRIPTION OF THE INVENTION

Figure 1:
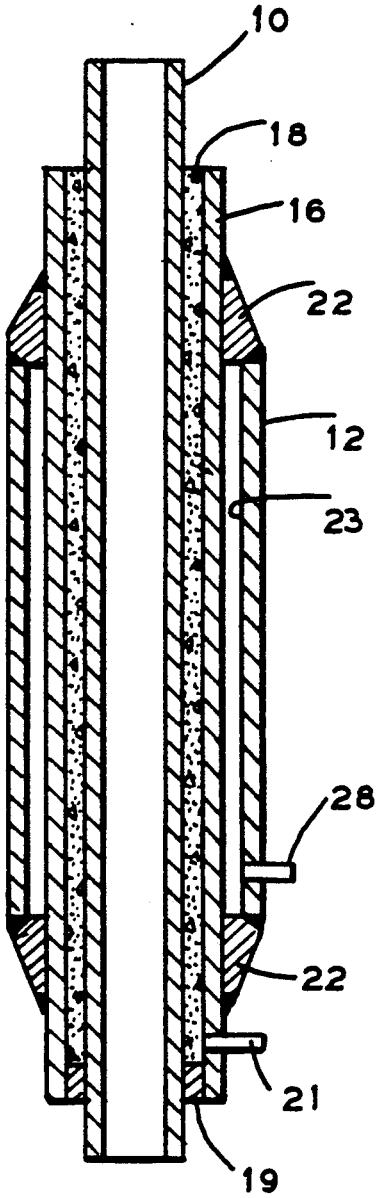
FIG. 1 is a cut-away sectional view of the skirt pile sleeve, insert, and skirt pile illustrating a grouted connection between the pile and the insert.

Referring to the drawings, there is shown skirt pile 10 inserted within skirt pile sleeve 12 that is, in turn, fixedly secured to platform 14. Intermediate pile 10 and sleeve 12 is elongated insert 16 that is secured to pile 10 by either grout 18, a swedge connection 20, or otherwise. Should grout 18 be used, grout packer 19 and grout plug 21 are incorporated with and form a part of insert 16. Insert 16 is, in turn, secured to sleeve 12 via a series of upper and lower shims 22 separately welded between the two. As shown, an unobstructed gap 23 exists between insert 16 and sleeve 12 with this gap 23 permitting insert 16 to be removed from sleeve 12 at some future time, if desired. In this fashion, the load from platform 14 travels from sleeve 12 through shims 22 to insert 16 and thence, via either grout 18, a swedge connection 20 or otherwise, to skirt pile lo. Generally, insert 16 is longer than sleeve 12 while, obviously, pile 10 is longer than both of them.

When platform 14 is to be salvaged and/or reused, the upper portion of all the skirt piles would first be separated (cut) from the embedded portion adjacent or below the mudline by conventional means. Afterwards, each of shims 22 would be cut thereby freeing the combination of insert 16 and pile 10 which would be withdrawn from sleeve 12. This, thus, enables platform 14 to be removed for later use.

Figure 3A:
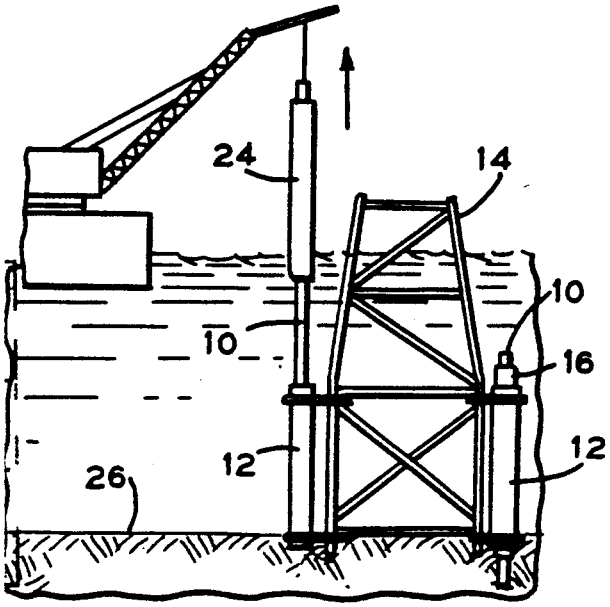
FIGS. 3*a–d* are pictorial views illustrating the various steps involved in salvaging and re-suing the platform.
Figure 3B:
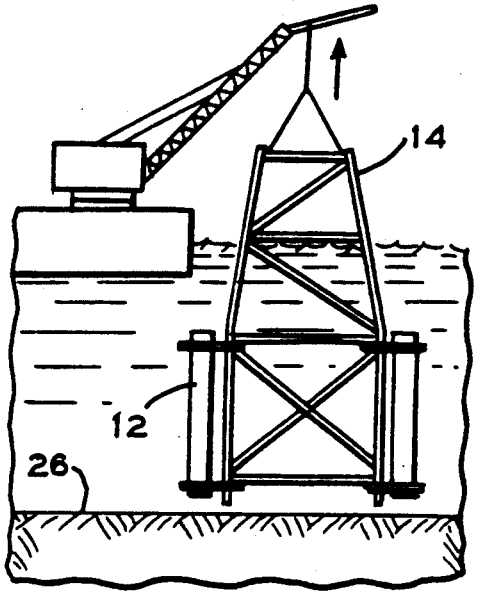
Figure 3C:
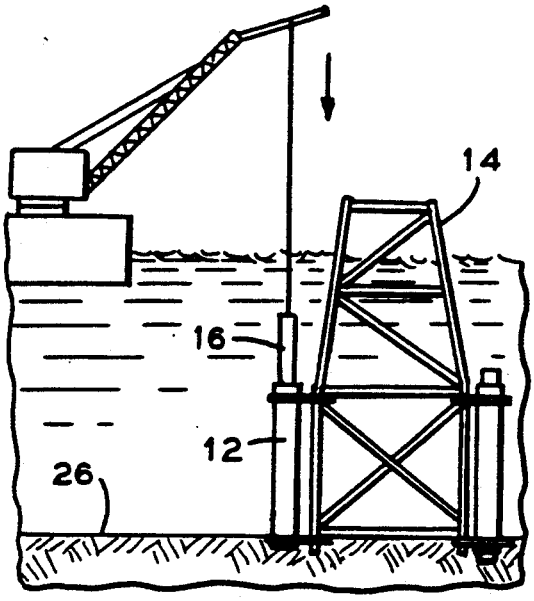
Figure 3D:
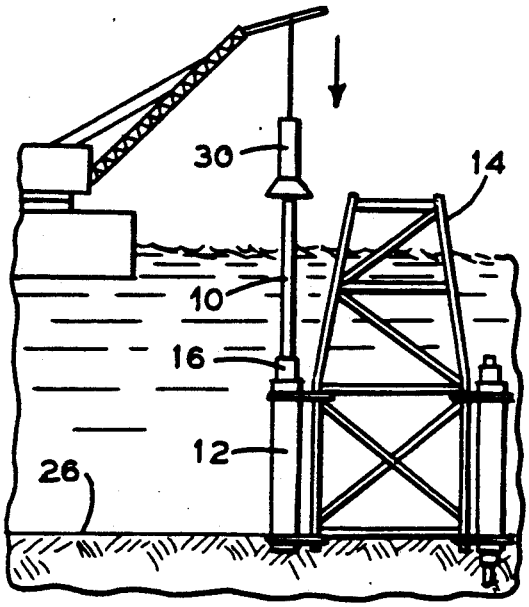

Should re-installation of platform 14 be desired, such steps as towing platform 14 to the new site, installing new inserts 16 within sleeves 12, and grouting or otherwise connecting inserts 16 to the newly driven skirt piles 10 would be required. FIGS. 3*a* thru 3*d* disclose these various steps. FIG. 3*a* illustrates the removal of the original skirt pile and insert combination 24 after shims 22 have been cut and after skirt pile 10 has been cut near or below mudline 26. FIG. 3*b* illustrates the lifting and relocation of platform 14. FIG. 3*c* illustrates the insertion of new inserts 16 after platform 14 has been reposiitoned. These new inserts 16 would then be grouted, swedged, or otherwise connected to sleeve 12. For this purpose, sleeve 12 is initially manufactured with grout plug 28 such that gap 23 may be filled with grout thereby securing new insert 16 to existing platform 14. FIG. 3*d* illustrates the installation of new skirt piles 10 via hammer 30 that are subsequently grouted or otherwise secured to insert 16.

Alternatively, should the new location require the use of skirt piles 10 that are larger than the ones used originally, the step of installing new inserts 16 within sleeves 12 can be eliminated. This will provide the room necessary for larger skirt piles that are subsequently grouted, swedged, or otherwise directly connected to sleeve 12. Of course, should such direct connection occur, there is no known way to break the grout bond, thus platform 14 would probably not be subject to future re-use since inserts 16 had been eliminated.

Figure 2:
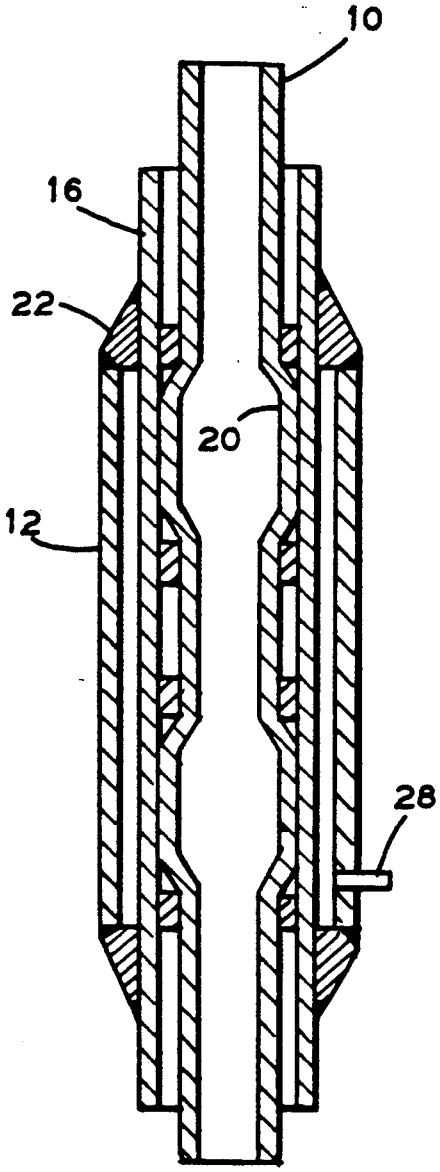
FIG. 2 is a cut-away sectional view of the skirt pile sleeve, insert, and skirt pile illustrating a swedged connection between the pile and the insert.
Figure 4A:
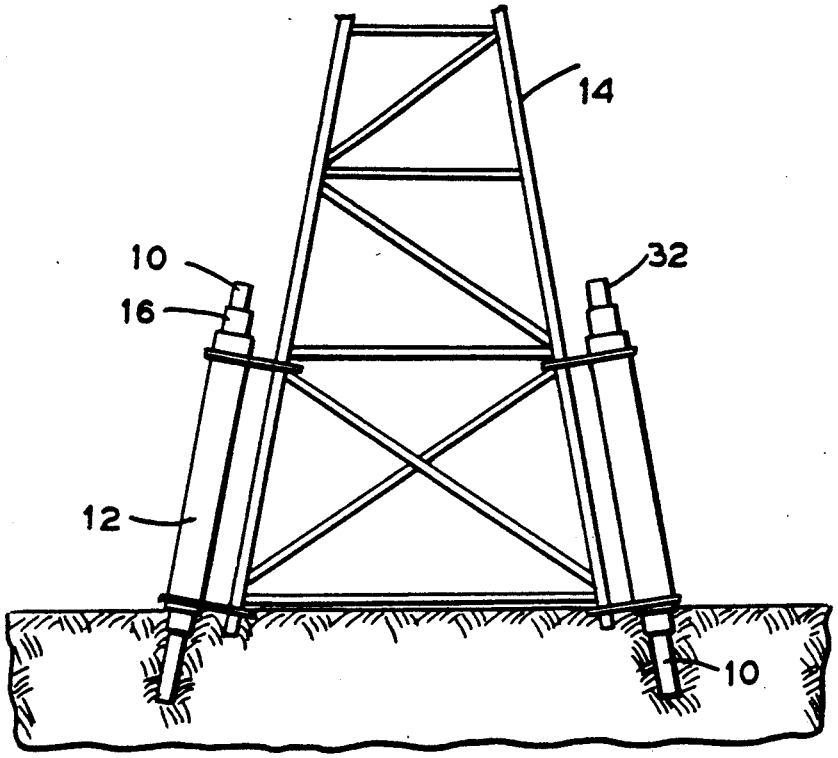
FIGS. 4 and 4*b* are pictorial views of the invention in use indicating that it may be used on platforms with battered or vertical skirt piles.
Figure 4B:
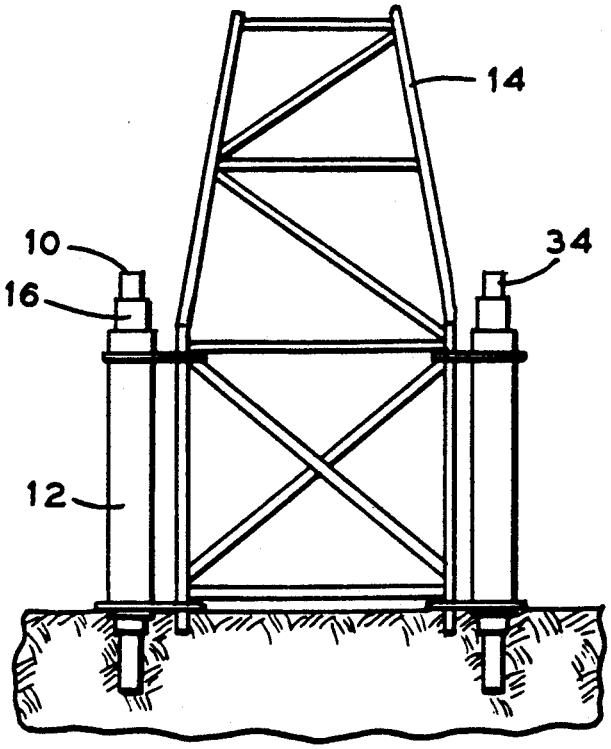

As can be seen, insert 16 is initially fabricated and installed along with the construction of platform 14. Shims 22 which secure insert 16 to sleeve 12 may be crown type as shown in FIGS. 1 and 2 or they may be the more conventional shear plate type, this latter type often being used to connect a pile to a jacket leg. Furthermore, and as illustrated in FIGS. 4*a* and 4*b*, insert 16 can be used on platforms having either battered type skirt piles 32 or vertical skirt piles 34.

Of course, the advantage of this invention is the future option of salvaging and re-using platform 14 at a cost far below that of building a new one or replacing the jacket legs on an existing one whose skirt piles 10 were directly grouted to pile sleeve 12. Cost savings can vary, of course, depending on water depth, platform size, number of piles, etc. but savings on the order of 50% to 80% can be expected over the cost of a new platform.

What is claimed as invention is:

1. A reusable apparatus for securing a skirt pile to a platform comprising:

(a) a skirt pile sleeve secured to the leg of an offshore platform, said sleeve having upper and lower end openings sized and configured to accept a skirt pile therethrough;

(b) an insert positioned within said sleeve and extending beyond both said end openings of said sleeve, said insert located intermediate said sleeve and said skirt pile;

(c) first connecting means for securing said sleeve to said insert, said first connecting means comprising upper and lower shims securing said insert to said sleeve, said shims being positioned around the perimeter of said upper and lower end openings whereby bending and axial forces are directly transferred from said sleeve to said insert via said upper and lower shims; and, (d) second connecting means for securing said insert to said pile whereby bending and axial forces are directly transferred from said insert to said pile.

2. The apparatus as set forth in claim 1 wherein a gap exists between said insert and said sleeve, said gap being enclosed, top and bottom, by said first connecting means.

3. The apparatus as set forth in claim 2 wherein said gap is unobstructed.

4. The apparatus as set forth in claim 3 wherein said shims are separately welded between said insert and said sleeve.

5. The apparatus as set forth in claim 4 wherein said sleeve is configured having a grout plug therein for the filling of said gap with grout.

6. The apparatus as set forth in claim 5 wherein said second connecting means comprise exterior grout supply means for creating a grout bond between said insert and said pile.

7. The apparatus as set forth in claim 5 wherein said second connecting means comprise a swedged connection between said insert and said pile.

8. The method of installing an offshore platform comprising the steps of:

(a) positioning a platform on the seabed floor, said platform having skirt pile sleeves pre-attached thereto configured with upper and lower end openings therein;

(b) installing, prior to said positioning, inserts within said sleeves, said inserts extending outward beyond said upper and lower openings in said sleeves;

(c) securing, prior to said positioning, said inserts to said sleeves via upper and lower shims positioned around the perimeter of said upper and lower openings;

(d) stabbing a skirt pile within said insert; and, (e) securing said pile to said insert.

9. The method as set forth in claim 8 further comprising the step of securing said insert to said sleeve by welding said shims between the two.

10. The method as set forth in claim 9 further comprising the step of grouting said pile to said insert.

11. The method as set forth in claim 9 further comprising the step of swedging said pile to said insert.

12. The method of salvaging an offshore platform secured in place by skirt piles comprising the steps of:

(a) separating that portion of a skirt pile embedded below the mudline from that portion situated above the mudline;

(b) disengaging a skirt pile sleeve secured to said platform from an interior insert which is connected to said skirt pile, said disengaging step comprising the step of cutting upper and lower shims welded between said sleeve and said insert;

(c) removing said skirt pile and said attached insert from said sleeve; and, (d) moving said offshore platform with said sleeves to a new location.

13. The method as set forth in claim 12 wherein said disengaging step comprises the cutting of a plurality of shims which are welded between said sleeve and said insert.

14. The method as set forth in claim 13 wherein said separating step comprises the cutting of said skirt pile.

15. A method of re-installing an offshore platform comprising the steps of:

(a) positioning a salvaged platform on the seabed floor, said platform having skirt pile sleeves attached thereto with said sleeves having upper and lower end openings therein;

(b) installing, prior to said positioning, an insert within each said sleeve and grouting the two together, said insert extending beyond both said end openings of said sleeve;

(c) stabbing a skirt pile within said insert and grouting said skirt pile to said insert.

16. The method as set forth in claim 15 wherein each said sleeve and each said insert are configured having a grout plug therein and further comprising the steps of grouting said sleeve to said insert and grouting said insert to said skirt pile.

* * * * *